US009339100B2

(12) United States Patent
Moreau et al.

(10) Patent No.: US 9,339,100 B2
(45) Date of Patent: May 17, 2016

(54) LANYARD ATTACHMENT ASSEMBLY

(75) Inventors: Darrell A. Moreau, Manchester, NH (US); Andre W. Moreau, Spring Hill, FL (US)

(73) Assignee: Ty-Flot, Inc., Manchester, NH (US)

( * ) Notice: Subject to any disclaimer, the term of this patent is extended or adjusted under 35 U.S.C. 154(b) by 144 days.

(21) Appl. No.: 13/545,050

(22) Filed: Jul. 10, 2012

(65) Prior Publication Data

US 2014/0013544 A1 Jan. 16, 2014

(51) Int. Cl.

| | |
|---|---|
| ***A45F 5/00*** | (2006.01) |
| ***A44B 13/00*** | (2006.01) |
| ***A44B 13/02*** | (2006.01) |

(52) U.S. Cl.

CPC ..... *A45F 5/00* (2013.01); *A44B 13/0058* (2013.01); *A44B 13/02* (2013.01); *A45F 2005/006* (2013.01); *A45F 2200/0575* (2013.01); *Y10T 24/1394* (2015.01); *Y10T 24/1397* (2015.01)

(58) Field of Classification Search

CPC ..... A45F 5/00; A45F 2200/0575; A45F 2005/006; A44B 13/0058; A44B 13/02; Y10T 24/1394; Y10T 24/1397

USPC ..... 24/3.1, 3.12, 3.13, 298, 299, 300, 301, 24/302, 265 AL

See application file for complete search history.

(56) References Cited

U.S. PATENT DOCUMENTS

| | | | | | |
|---|---|---|---|---|---|
| 2,858,733 | A * | 11/1958 | Lodewick et al. | ..... | 351/157 |
| 4,168,754 | A | 9/1979 | Nyholm | | |
| 4,315,641 | A * | 2/1982 | Larsen | ..... | 280/822 |
| 4,558,495 | A * | 12/1985 | Olsen | ..... | 24/298 |
| 5,082,156 | A * | 1/1992 | Braun | ..... | 224/220 |
| 5,150,504 | A * | 9/1992 | Cohen | ..... | 24/302 |
| 5,361,866 | A * | 11/1994 | Bell et al. | ..... | 182/3 |
| D410,330 | S * | 6/1999 | Klein | ..... | D3/221 |
| 6,216,319 | B1 * | 4/2001 | Elkins | ..... | 24/3.2 |
| 6,648,197 | B2 * | 11/2003 | Perry | ..... | 224/604 |
| 7,020,935 | B2 * | 4/2006 | Behn et al. | ..... | 24/298 |
| 7,484,273 | B1 * | 2/2009 | Dupree et al. | ..... | 24/3.13 |
| 2002/0035829 | A1 * | 3/2002 | Sorsi | ..... | 59/93 |
| 2003/0102342 | A1 * | 6/2003 | Fogg | ..... | 224/269 |
| 2004/0069823 | A1 | 4/2004 | Condiff | | |
| 2005/0085350 | A1 * | 4/2005 | Shen | ..... | 482/91 |
| 2006/0237498 | A1 | 10/2006 | Piatt, Sr. et al. | | |
| 2007/0095870 | A1 * | 5/2007 | Griffith et al. | ..... | 224/219 |
| 2008/0010787 | A1 * | 1/2008 | Kinskey | ..... | 24/298 |
| 2008/0083803 | A1 | 4/2008 | Brantner et al. | | |
| 2008/0163464 | A1 * | 7/2008 | Baumann | ..... | 24/3.12 |

(Continued)

OTHER PUBLICATIONS

PCT Notification of Transmittal of the International Search Report and Written Opinion of the International Searching Authority, PCT/US2013/023477 (May 15, 2013).

(Continued)

*Primary Examiner* — Robert J Sandy
*Assistant Examiner* — David Upchurch
(74) *Attorney, Agent, or Firm* — Mesmer & Deleault PLLC

(57) ABSTRACT

A lanyard attachment assembly has a sleeve with an inside surface and an outside surface. The inside surface defines a passageway through the sleeve. A strap passes through the passageway and forms a closed loop to link the closed loop to the sleeve. The assembly optionally includes a connector with a connector opening therethrough. When the assembly includes a connector, the strap passes through the connector opening where the closed loop links the connector to the sleeve.

14 Claims, 7 Drawing Sheets

(56) References Cited

U.S. PATENT DOCUMENTS

| | | | | |
|---|---|---|---|---|
| 2009/0007389 | A1* | 1/2009 | Pfannkuch | 24/3.12 |
| 2009/0056731 | A1* | 3/2009 | Tokko | 132/53 |
| 2009/0095039 | A1* | 4/2009 | Nagamine | 70/457 |
| 2009/0127302 | A1* | 5/2009 | Pruitt | 224/219 |
| 2009/0272775 | A1* | 11/2009 | Moreau et al. | 224/251 |
| 2009/0276979 | A1 | 11/2009 | Kauffman et al. | |
| 2011/0042533 | A1 | 2/2011 | Austin | |
| 2011/0289733 | A1* | 12/2011 | Del Solar et al. | 24/3.12 |
| 2014/0196258 | A1* | 7/2014 | Votel et al. | 24/265 R |
| 2014/0304952 | A1* | 10/2014 | Mathews et al. | 24/302 |

OTHER PUBLICATIONS

European Patent Office, Supplementary European Search Report, EP application No. 13 817 379.4 (Dec. 22, 2015).

* cited by examiner

LANYARD ATTACHMENT ASSEMBLY

BACKGROUND OF THE INVENTION

1. Field of the Invention

The present invention relates generally to hand tools and accessories. More particularly, the present invention relates to a lanyard attachment assembly for hand tools and other objects.

2. Description of the Prior Art

Hand tools are widely used in construction, maintenance, and industrial facilities operations. The user of a tool often stores tools in a bag, box, pouch, or tool belt when the tool is not being used. The user then selects the appropriate tool for a given task and returns the tool to its storage location after the task is complete. For tasks performed at elevated heights, dropping a tool can cause injury to individuals or damage to objects below the worker. The dropped tool also is a significant inconvenience for workers who must spend time to retrieve the dropped tool.

Tool makers have partially addressed the problem of dropped tools by attaching a ring to a tool by connecting the ring through an opening in the end of the tool handle. For example, a metal ring passes through an opening in the end of a handle of a hammer or pipe wrench. Another method of addressing this problem is to attach a ring or grommet to the tool by forming a sleeve over the end of the tool's handle or grip where the sleeve has a solid end with an opening in the solid end. For example, one line of tools includes hammers, hinged pliers, and adjustable spanners that have a rubber sleeve formed over the grip of the tool with a solid end portion of the sleeve extending beyond the end of the grip. A ring passes through an opening or grommet in the solid end of the rubber sleeve. The user clips one end of a lanyard to the ring and attaches the other end of the lanyard to the user's tool belt, scaffolding, ladder, or other object.

Another method of addressing the problem of dropped tools is a lanyard attachment assembly that includes a connector attached to a leader. The leader is a generally-flat strip of material that is secured to a tool by heat shrink tubing slipped over both the tool and the leader. The heat shrink tubing is subsequently heated, thereby shrinking the tubing to provide a snug fit over the leader and securing the leader to the tool.

SUMMARY OF THE INVENTION

One limitation of currently-available tool lanyard attachment methods is that some methods rely on the tool having an unused or free end of the handle to which a rubber sleeve or ring may be attached. This design is not useful, however, for two-ended tools with functional features on each end of the tool. A combination wrench, for example, has one open end and one box end to provide dual functionality. Attaching a ring by using a sleeve formed over either end of the combination wrench renders that end of the wrench useless for its intended use. Similarly, connecting a ring through the box-end of a wrench renders that end useless for turning bolts because the ring is in the way of the bolt head.

One limitation of lanyard attachment assemblies that include a leader secured to the tool with heat shrink tubing is that this design has proven unreliable. The assembly fails because the leader may be inadvertently pulled out from the heat shrink tubing.

Therefore, what is needed is an improved lanyard attachment assembly for hand tools and other objects.

It is an object of the present invention to provide a lanyard attachment that reinforces safety.

It is also an object of the present invention to provide a lanyard attachment that increases productivity.

It is also an object of the present invention to provide a lanyard attachment that reduces operating costs.

It is also an object of the present invention to improve reliability of lanyard attachment assemblies.

The present invention achieves these and other objectives by providing a lanyard attachment assembly having a sleeve, a strap forming a closed loop, and an optional connector. In one embodiment of the present invention, the lanyard attachment assembly has a sleeve with an inside surface and an outside surface. The inside surface of the sleeve defines a passageway through the sleeve. The assembly also has a strap forming a closed loop that passes through the passageway of the sleeve, thereby linking the strap to the sleeve.

In another embodiment of the present invention, the lanyard attachment assembly has a connector with an opening through the connector. In this embodiment, the strap also passes through the connector opening, linking the sleeve to the connector.

In another embodiment of the present invention, the closed loop has a first end portion and an opposite second end portion. The closed loop also has a first strap portion and a second strap portion that is aligned with and opposed to the first strap portion. The first strap portion and the second strap portion each extend between the first end portion and the second end portion. The first end portion of the closed loop includes a first turn between the first strap portion and the second strap portion. The second end portion of the closed loop includes a second turn between the first strap portion and the second strap portion.

In another embodiment of the present invention, one or both of the first turn and the second turn is configured so that the strap folds back on itself and the first strap portion is secured to the second strap portion at a connection point to define one or more additional strap openings. In another embodiment of the present invention, the first strap portion is connected to the second strap portion at the connection point by stitching, an adhesive, a closed loop encircling the connection point, one or more staples, one or more clips, one or more crimp bands, one or more clamps, or a combination of these devices.

In another embodiment of the present invention, the assembly has a plurality of connectors. In one embodiment, the plurality of connectors includes a first connector and a second connector. A first strap end of the strap folds back at a first fold onto the strap and is connected to the strap at a first connection point to define a secondary opening through which passes a portion of the first connector. A second strap end of the strap folds back at a second fold onto the strap and is connected to the strap at a second connection point to define an additional secondary opening through which passes a portion of the second connector. A closed loop is formed by the first fold passing through the opening of the second connector to overlap the second fold or by the second fold passing through the opening of the first connector to overlap the first fold.

In another embodiment of the present invention, the sleeve is heat shrink tubing having a shrink ratio preferably between about 2:1 and about 4:1.

In another embodiment of the present invention, the assembly has an adhesive disposed on the inside surface of the sleeve. The adhesive in one embodiment is heat-activated.

In another embodiment of the present invention, the connector is a D-ring, an O-ring, a carabiner, a shackle, split ring, a tri-loop, an open ring, a loop, a hook, or a snap hook.

In another embodiment of the present invention, the strap is made of polymeric material, metal, or a combination of these materials.

In one method of making a lanyard attachment assembly, a length of strap having a first strap end and second strap end is selected. The first strap end or the second strap end is passed through the passageway of the sleeve. The first strap end or the second strap end also passes through the connector opening of one or more connectors. The first strap end is then positioned to overlap the second strap end and the overlapping portion of the strap is fixedly secured with one or more fastening means to form a closed loop with a primary opening therethrough. The resulting assembly includes a sleeve linked to a connector by a strap forming a closed loop.

Optionally, the first strap portion and the second strap portion are fixedly secured together at connection points with fastening means to define one or more fastener receiving openings or secondary openings. In another embodiment of making the lanyard attachment assembly, the connector is not included, in which case the assembly includes a sleeve linked to a strap forming a closed loop. In a preferred embodiment of a method of making a lanyard attachment assembly, the sleeve is heat shrink tubing, the strap is woven nylon webbing, and the connector(s) is (are) a metal D-ring.

DETAILED DESCRIPTION OF THE PREFERRED EMBODIMENT

Figure 1:
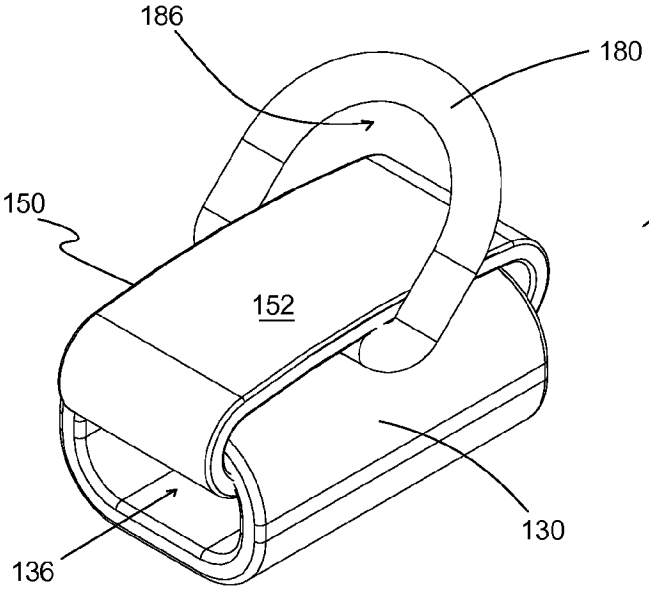
FIG. 1 illustrates a perspective view of one embodiment of a lanyard attachment assembly of the present invention showing a sleeve, a strap, and an optional connector.

The preferred embodiments of the present invention are illustrated in FIGS. 1-11. FIG. 1 illustrates a perspective view of one embodiment of a lanyard attachment assembly 100 having a sleeve 130, a strap 150, and an optional connector 180. Strap 150 passes through passageway 136 of sleeve 150 and through opening 186 of connector 180. Strap 150 is fixedly secured to itself, forming a closed loop 152 and linking sleeve 130 to connector 180.

Figure 2:
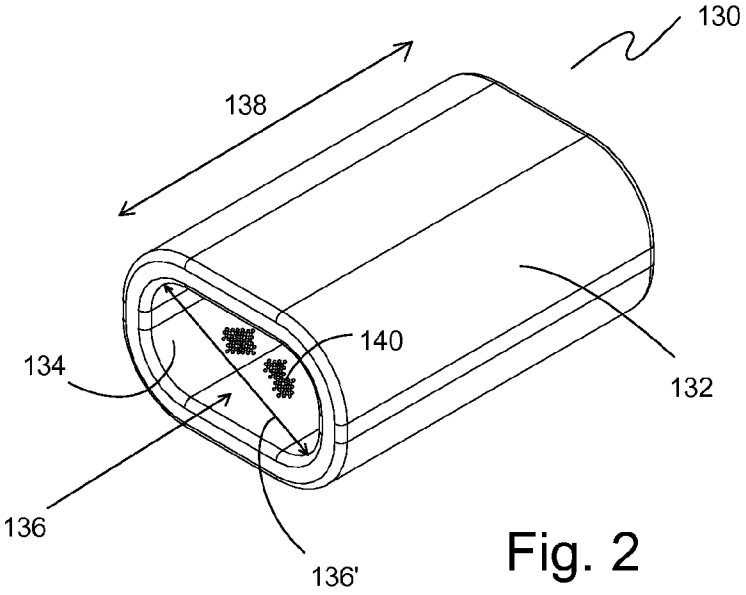
FIG. 2 illustrates one embodiment of a sleeve of the present invention.

FIG. 2 illustrates an embodiment of sleeve 130 as shown in lanyard attachment assembly 100 of FIG. 1. Sleeve 130 is preferably a length of plastic or rubber tubing that has an outside surface 132 and an inside surface 134. Inside surface 134 defines a passageway 136 extending longitudinally through sleeve 130; inside surface 134 corresponds to inside diameter 136' of sleeve 130. Sleeve 130 preferably has a length 138 between 1.5 inches and 4 inches, but is not limited to these lengths. Sleeve 130 optionally has adhesive 140 disposed on inside surface 134 of sleeve 130. In one embodiment, adhesive 140 is heat activated, but other adhesives 140 are acceptable and include, for example, air-cured adhesives, chemically-activated adhesives, anaerobic adhesives, cyanoacrylate adhesives, pressure-sensitive adhesives, epoxies, and various other adhesives.

In one embodiment, sleeve 130 is made of extruded thermoplastic heat shrink tubing. Sleeve 130 is mechanically expanded after extrusion where inside diameter 136' represents the sleeve's expanded state. When heated, sleeve 130 is capable of returning to its relaxed state with a smaller inside diameter 136'. Heat shrink tubing is commonly made of polyolefin, fluoropolymers, nylon, PVC, silicon elastomer, neoprene, or a fluoropolymer elastomer, such as the fluoropolymer elastomer made by DuPont under the name Viton™. The ratio of the heat shrink tubing's inside diameter 136' in its expanded state to its inside diameter 136' in its relaxed state is known as the shrink ratio. The shrink ratio can be 6:1 or greater in some shrink tubing. Preferably, the shrink ratio for sleeve 130 is 4:1, 3:1, or 2:1, but this ratio is selected based on the difference in size between the tool's ends 112, 114 and the portion of tool 110 where lanyard attachment assembly 100 is to be installed, such as the handle or middle portion 116 of tool 110. For example, a smaller shrink ratio can be used with a hex wrench, which has ends 112, 114 that are substantially identical in size to the handle or middle portion 116 between ends 112, 114. In contrast, for a combination wrench, a larger shrink ratio would be appropriate due to the difference in overall size between middle portion 116 and first or second ends 112, 114.

In another embodiment, sleeve 130 is made of rubber. Sleeve 130 preferably has inside diameter 136' corresponding to a sleeve circumference that is smaller than the circumference of the portion of tool 110 where sleeve 130 is to be installed. The elastic properties of sleeve 130 are sufficient for inner diameter 136' of sleeve to be expanded (e.g., stretched) so sleeve 130 passes over at least one of ends 112, 114 of tool 110 and positioned over the tool's handle, middle portion 116, or other part. Sleeve 130 then is allowed to resume its relaxed state to the extent possible to create a snug fit to tool 110.

Figure 3:
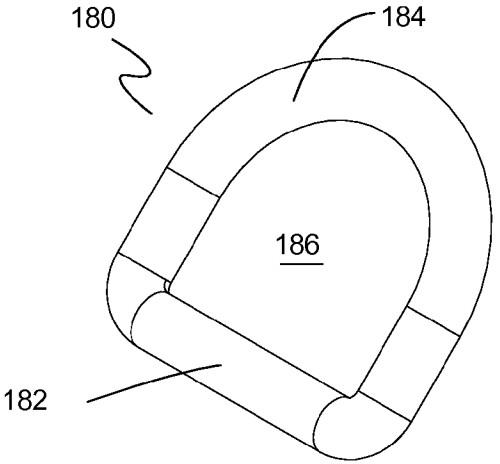
FIG. 3 illustrates one embodiment of a connector of the present invention showing a D-ring.

FIG. 3 shows one embodiment of connector 180 with opening 186 through connector 180. Connector is preferably a metal D-ring having a straight section 182 connected across a U-shaped section 184. Connector may be any other closed or partially-closed connector including an O-ring, a carabiner, a shackle, split ring, a tri-loop, an open ring, a loop, a snap hook, a spring clip, or a spring buckle. Connector 180 in some embodiments has multiple openings 186, such as some buckle clips, for example. Connector 180 may be made of any material suitable for the user's desired strength, durability, and weight requirements. Materials for connector 180 include, for example, steel, aluminum, metal alloys, rubber, cloth, rope, plastic, reinforced composites, wire, and the like.

Figure 4:
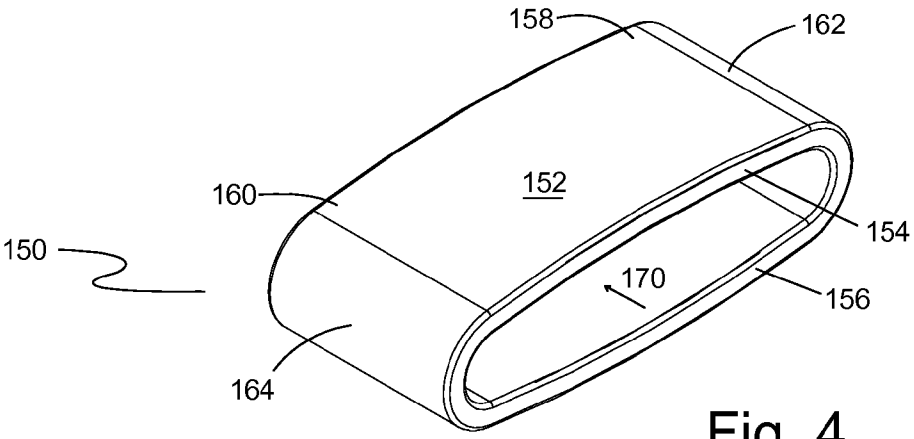
FIG. 4 illustrates one embodiment of a strap of the present invention.

FIG. 4 illustrates one embodiment of strap 150 as shown in the embodiment illustrated in FIG. 1. Strap 150 is preferably nylon webbing, but strap 150 may be made of other woven, non-woven, knitted, braided, or solid materials including, but not limited to rubber, cloth, metal, and plastic. In some embodiments, strap 150 is made of knitted, woven, or braided elastic webbing that is capable or stretching 25%, 50%, 75%, 100%, or more of its original, unstretched length.

Strap 150 forms a closed loop 152 having a first end portion 158 and a second end portion 160. Closed loop 152 also has a first strap portion 154 and a second strap portion 156 generally aligned with and opposing first strap portion 154. First strap portion 154 and second strap portion 156 each extend between first end portion 158 and second end portion 160. First end portion 158 of closed loop 152 includes a first fold or first turn 162 between first strap portion 154 and second strap portion 156; second end portion 160 includes a second fold or second turn 164 between first strap portion 154 and second strap portion 156.

Figure 5:
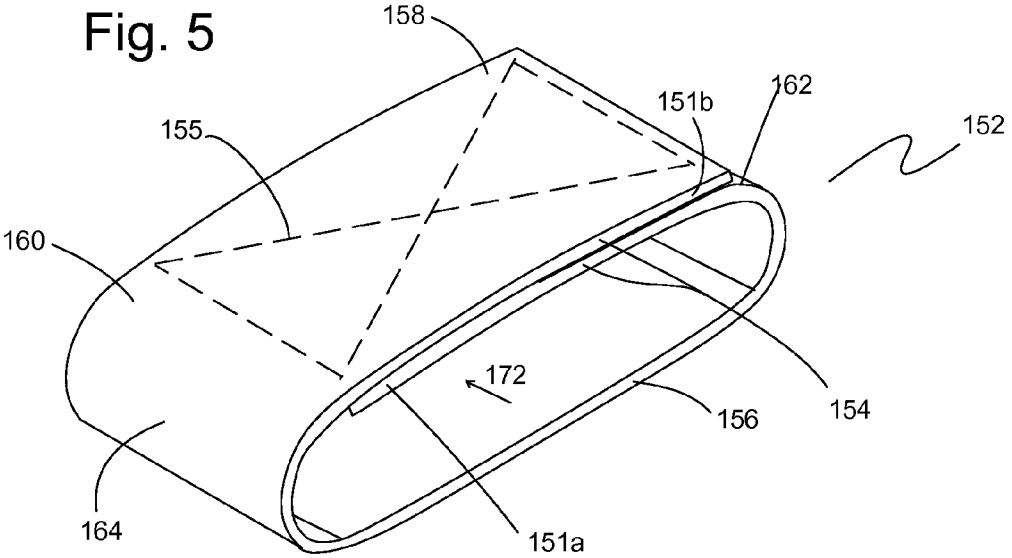
FIG. 5 illustrates another embodiment of a strap of the present invention showing overlapped end portions of the strap fixedly bound to each other.

FIG. 5 illustrates another embodiment of closed loop 152 of strap 150. In this embodiment, strap 150 has a first strap end 151*a* and a second strap end 151*b*. First strap end 151*a* overlaps in an opposed direction and is fixedly secured to second strap end 151*b*, forming closed loop 152. Closed loop 152 defines primary opening 172 therethrough. Overlapping portions of first strap end 151*a* and second strap end 151*b* are fixedly secured together with one or more fastening means 155. Fastening means 155 is preferably stitching. Other acceptable fastening means 155 include, for example, a rivet, a staple, a clip, adhesive, fusion, and the like.

Optionally, closed loop 152 is seamless and continuous where an open connector 180 (not shown) and open sleeve 130 (not shown) is passed through primary opening 172 and subsequently closed to link sleeve 130, strap 150, and connector 180. For example, connector 180 is convertible between an open position and a closed position (e.g., a split ring or carabiner). Connector 180 is passed through primary opening 172 in its open position and is then converted to its closed position to link connector 180 to closed loop 152. Similarly, a strip of rubber or neoprene, for example, may be closed or seamed together after passing it through primary opening 172 of closed loop 152, forming sleeve 130 and linking it to closed loop 152.

Figure 6:
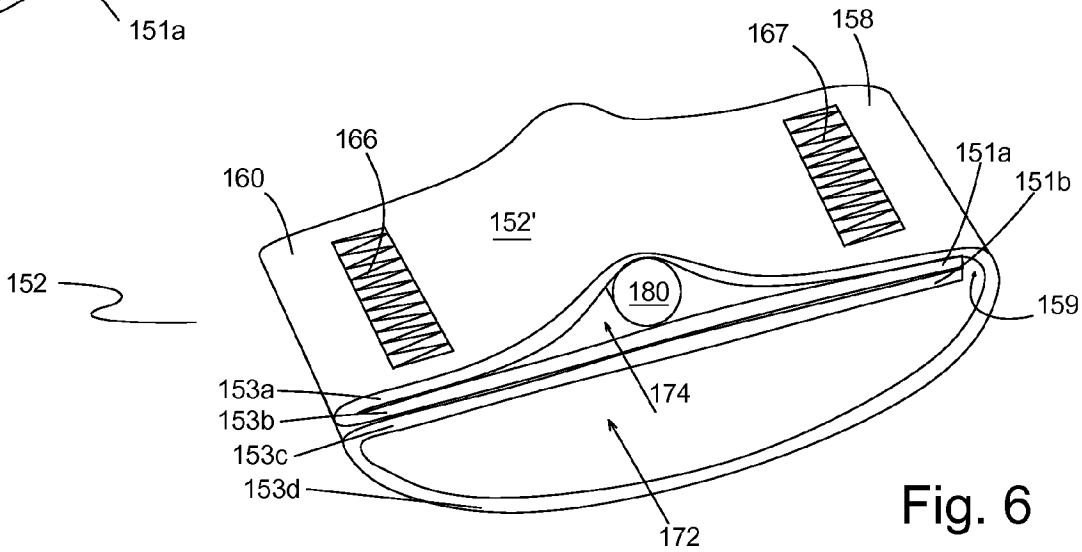
FIG. 6 illustrates another embodiment of a strap of the present invention showing overlapped end portions where one end portion also overlaps on itself to form a connector receiving opening.

FIG. 6 illustrates another embodiment of strap 150. In this embodiment, strap 150 forms a multi-layered closed loop 152' where first strap end 151*a* and second strap end 151*b* each fold towards a middle location 159 of strap 150. Strap 150 is then folded again at or near middle location 159 with first strap end 151*a* and second strap end 151*b* positioned on the inside of the fold and extending in the same direction. The resulting structure is a closed loop 152' with overlapping layers 153*a*-153*d* and defining primary opening 172 and one or more connector receiving openings or secondary openings 174 between layers of closed loop 152'.

First strap end 151*a* and second strap end 151*b* preferably occupy middle layer 153*b* and second middle layer 153*c*, respectively. Portions of strap 150 between first strap end 151*a* and second strap end 151*b* occupy first layer 153*a* and end layer 153*d*. Fastening means 166, 167 secure together first layer 153*a*, middle layer 153*b* (first strap end 151*a*), and second middle layer 153*c* (second strap end 151*b*) at spaced-apart locations. Fastening means 166, 167 are preferably stitching, but other fastening means may be used as described above. Closed loop 152' has primary opening 172 between second middle layer 153*c* and end layer 153*d*. Closed loop 152' has a connector receiving opening or secondary opening 174 between first layer 153*a* and middle layer 153*b*. A portion of sleeve 130 passes through primary opening 172 between second middle layer 153*c* and end layer 153*d* to link together strap 150 and sleeve 130. A portion of connector 180 (e.g., straight section 182 of a D-ring) passes through secondary opening 174 between first layer 153*a* and middle layer 153*b* to link together strap 150 and connector 180.

Optionally, only second strap end 151*b* folds towards middle location 159 of strap 150 and strap 150 is then folded at or near middle location 159 towards first end 151*a*. The resulting closed loop 152' includes first layer 153*a* (first strap end 151*a*), but omits middle layer 153*b*. Closed loop 152' also includes second middle layer 153*c* (second strap end 151*b*) and end layer 153*d* (the portion of strap 150 between first strap end 151*a* and second strap end 151*b*). First strap end 151*a* preferably terminates towards one end of closed loop 152' (e.g., second end portion 160) adjacent fastening means 166, while second strap end 151*b* terminates towards the opposite end of closed loop 152' (e.g., first end portion 158) adjacent fastening means 167. First strap end 151*a* optionally extends beyond second end 160 of closed loop 152' and may wrap around the outside of closed loop 152' along end layer 153*d* towards first end portion 158.

Figure 7:
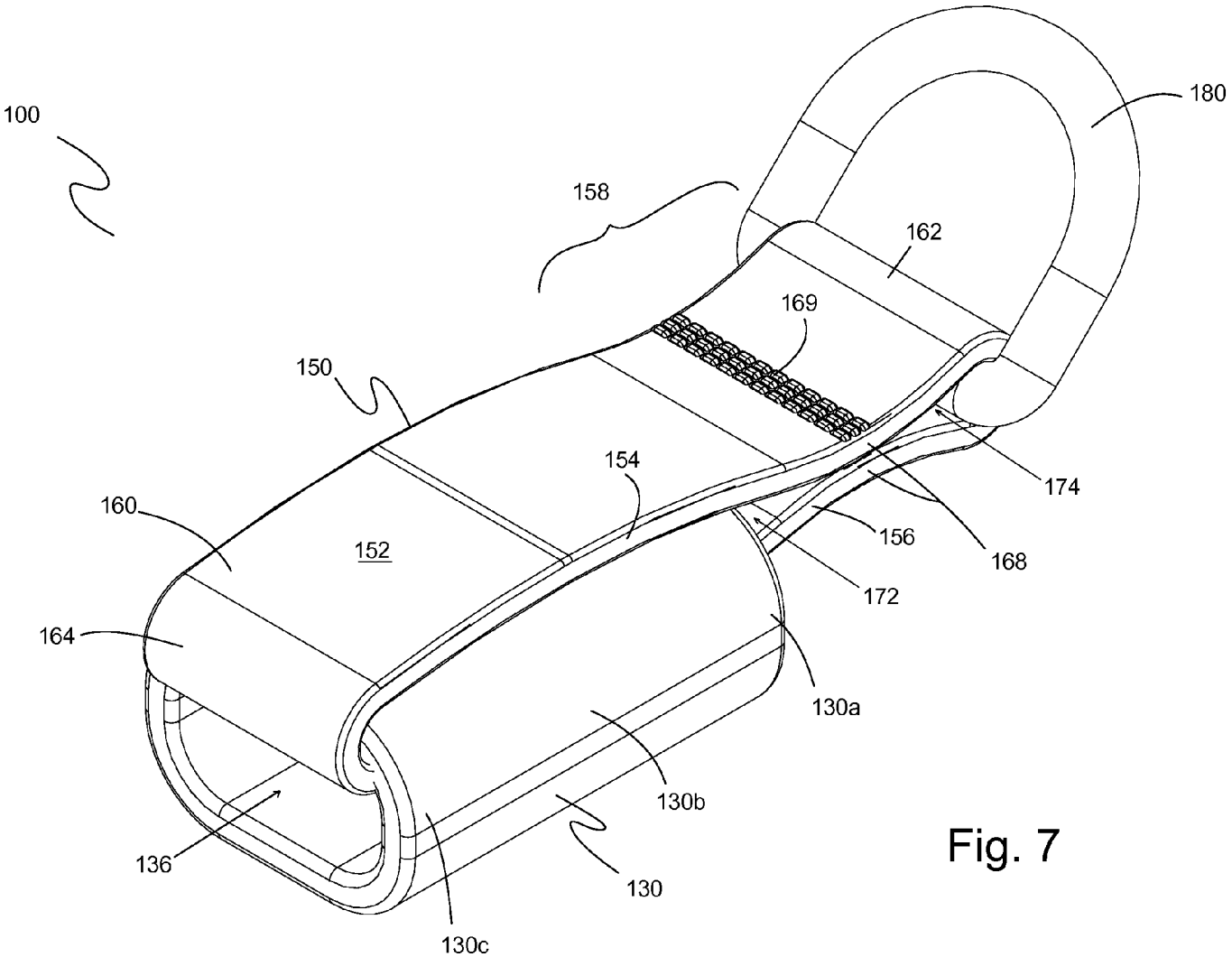
FIG. 7 illustrates another embodiment of a strap of the present invention with a connector and sleeve showing a connection receiving opening and a strap connection point.

FIG. 7 illustrates another embodiment of strap 150 as part of lanyard attachment assembly 100 with sleeve 130 and optional connector 180. In this embodiment, strap 150 forms a closed loop 152 that defines a primary opening 172 and a secondary opening 174 through closed loop 152. Forming primary opening 172 and secondary opening 174, fastening means 169 secures first strap portion 154 to second strap portion 156 at a first strap connection point 168 that is positioned between first turn 162 and second turn 164. Fastening means 169 is preferably stitching and may be replaced or supplemented by one or more other fastening means as described above. A portion of sleeve 130 passes through primary opening 172 to link sleeve 130 to strap 150. A portion of connector 180 passes through secondary opening 174 of closed loop 152, linking connector 180 to strap 150. Thus, sleeve 130, strap 150, and connector 180 are linked together.

First end portion 158 of closed loop 152 includes first turn 162, fastening means 169, secondary opening 174, and portions of first strap portion 154 and second strap portion 156 that are positioned between fastening means 169 and first turn 162. First end portion 158 in one embodiment is positioned to extend from a first sleeve end 130*a* away from sleeve 130 so as to lay flat along an adjacent handle or middle portion of a tool. Alternately, first end portion 158 may be positioned over a middle sleeve portion 130*b* so as to extend transversely away from middle sleeve portion 130*b* and, when installed on a tool 110, in a transverse direction away from the handle or middle portion of tool. For example, first end portion 158 is positioned over sleeve 130 by rotating closed loop 152 about sleeve 130 by approximately 90 degrees (as compared with the position shown in FIG. 7, which is considered to be in a 0-degree position). Rotating closed loop 152 about sleeve 130 in order to position first end portion 158 as desired is facilitated by making strap 150 of a flexible strap material that conforms to the shape of sleeve 130 as needed. Flexible strap materials include, for example, woven nylon, cotton, woven or non-woven fabrics, and polypropylene strapping.

Figure 8:
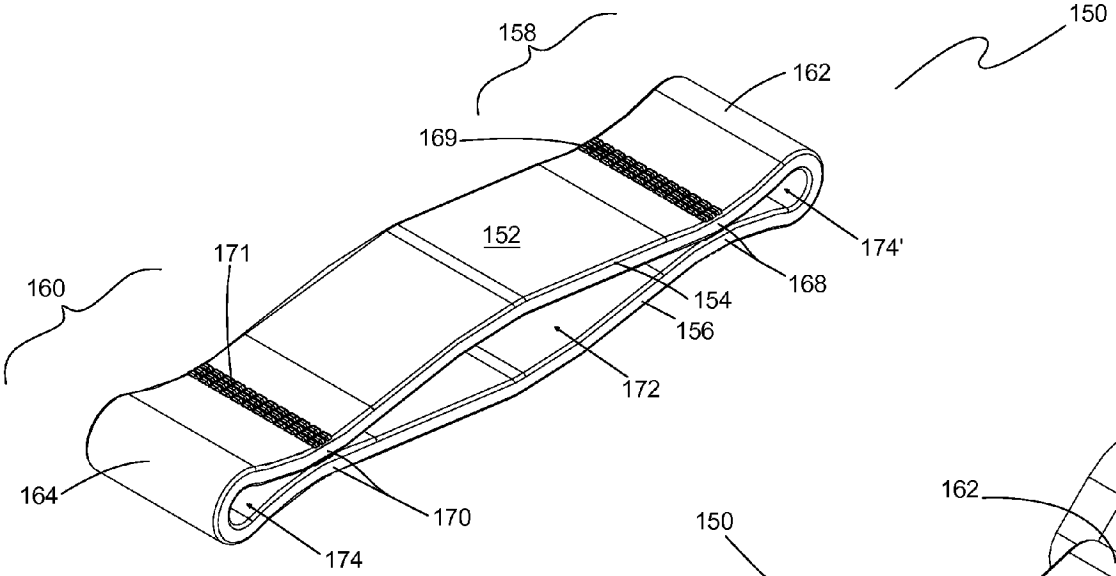
FIG. 8 illustrates another embodiment of a strap of the present invention showing a secondary opening and an additional strap connection point.

FIG. 8 illustrates a further embodiment of strap 150. First end portion 158 of closed loop 152 includes a first strap connection point 168 where first strap portion 154 and second strap portion 156 are fixedly secured together by fastening means 169 as described above. Similarly, second end portion 160 includes a second strap connection point 170 where first strap portion 154 and second strap portion 156 are also fixedly secured together by fastening means 171 as described above. Fastening means 169, 170 are preferably stitching.

By including strap connection points 168, 170, strap 150 forms closed loop 152 that defines primary opening 172, secondary opening 174, and an additional secondary opening 174', each of which pass between first and second strap portions 154, 156 of closed loop 152. Primary opening 172 is defined between first strap portion 154, second strap portion 156, first strap connection point 168, and second strap connection point 170. Secondary opening 174 is defined between first strap connection point 168, first turn 162, and portions of first and second strap portions 154, 156 that are between first strap connection point 168 and first turn 162. Similarly, additional secondary opening 174' is defined between second strap connection point 170, second turn 164, and portions of first and second strap portions 154, 156 that are between second strap connection point 170 and second turn 164. More additional secondary openings 174' may be similarly created by adding more strap connection points to closed loop 152.

Figure 9:
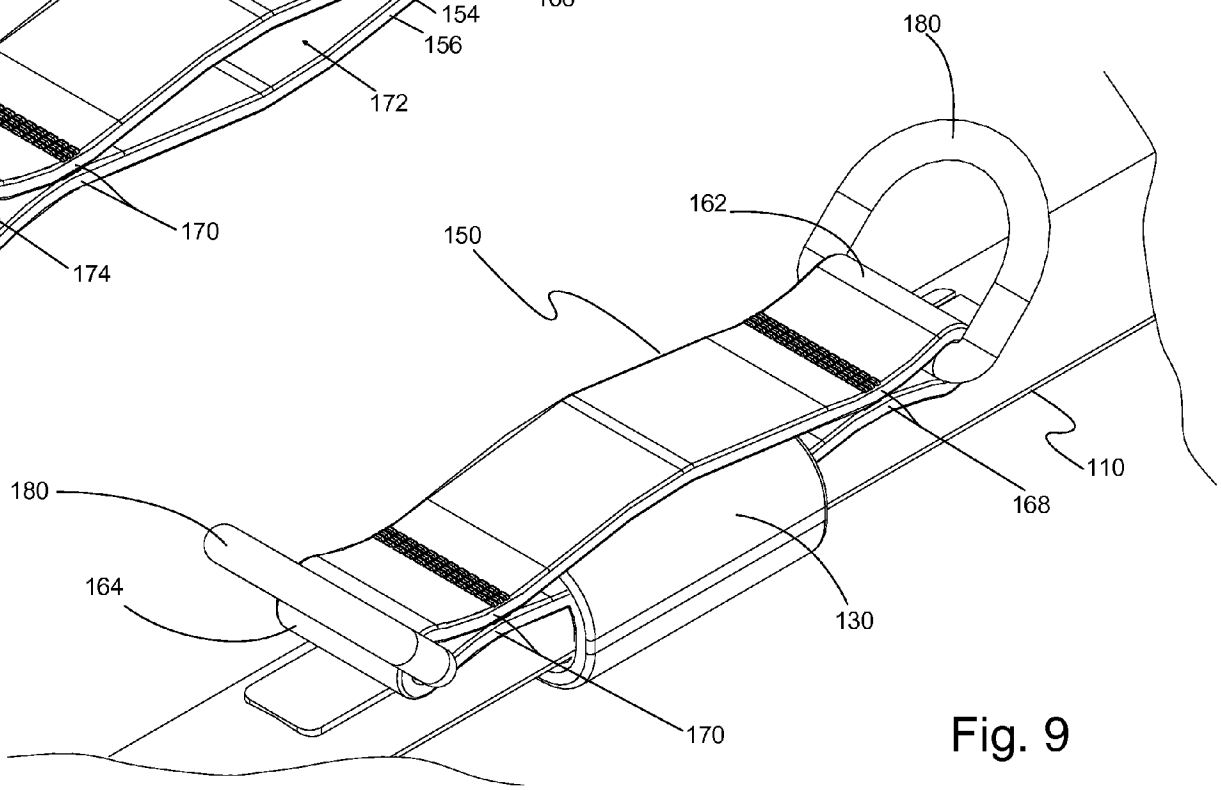
FIG. 9 illustrates the strap of FIG. 9 used as part of a lanyard attachment assembly installed on a hand tool.

FIG. 9 shows the embodiment of strap 150 shown in FIG. 8 installed on a hand tool 110 as part of lanyard attachment assembly 100 with sleeve 130 and connector 180. Sleeve 130 passes through primary opening 172 to link sleeve 130 to strap 150; connector 180 passes through secondary opening 174 to link connector 180 to strap 150. Lanyard attachment assembly 100 may have one or more connectors 180 passing through any or all of primary opening 172, secondary opening 174, and additional secondary opening(s) 174'. First and second strap connection points 168, 170 may be spaced from sleeve 130 for ease of assembly.

Figure 10:
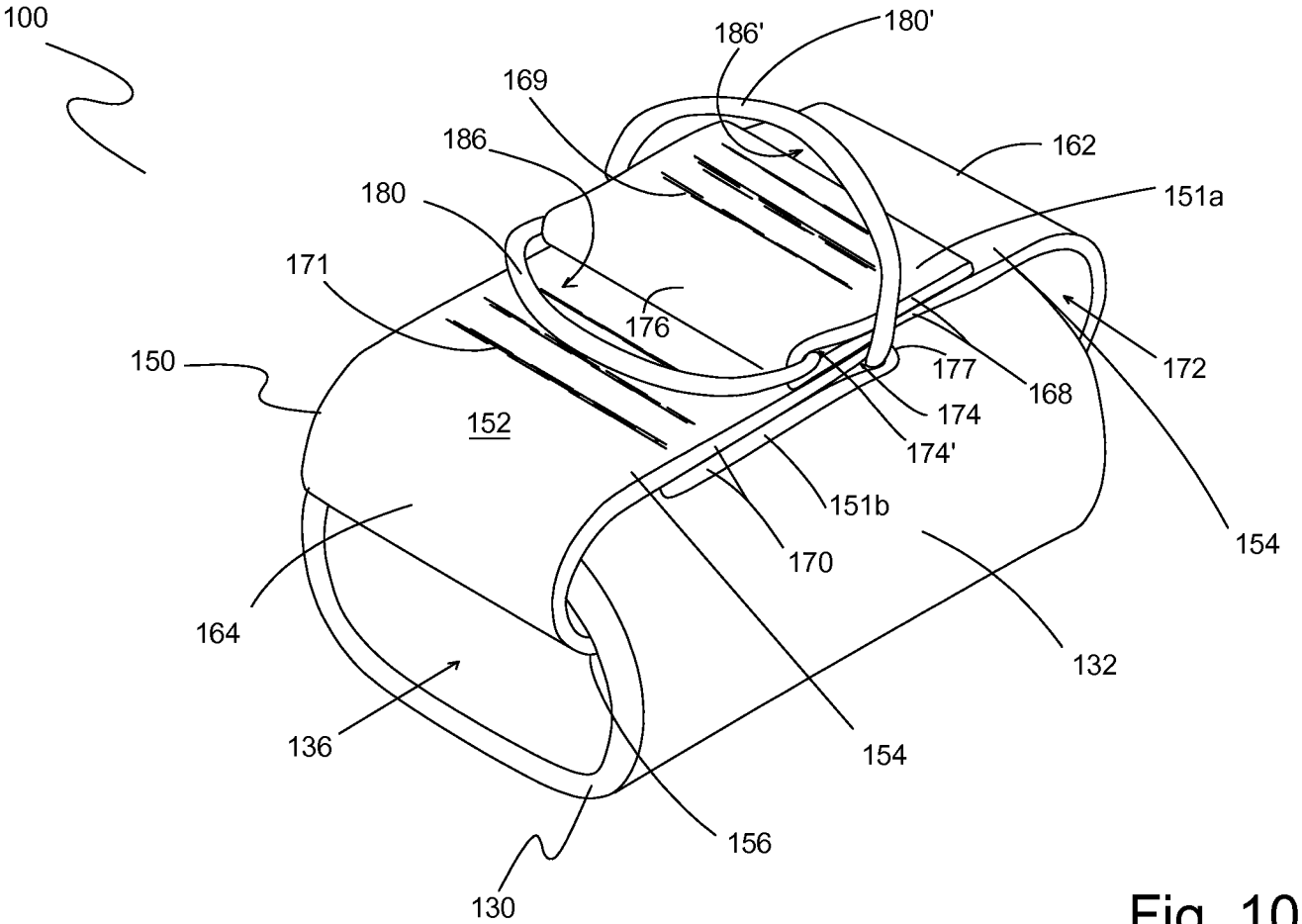
FIG. 10 illustrates a further embodiment of a strap as part of a lanyard attachment assembly of the present invention showing multiple connectors.

FIG. 10 illustrates a further embodiment of strap 150 as part of lanyard attachment assembly 100 with sleeve 130 and connectors 180, 180'. In this embodiment, strap 150 extends through sleeve 130 and has first strap end 151*a* and second strap end 151*b*. Secondary opening 174 is formed by folding strap 150 to create a first fold 176, where first strap end 151*a* extends a predefined distance sufficient to form first connection point 168 defined by first strap end 151*a* and a portion of strap 150. First strap end 151*a* is fixedly attached at a first connection point 168 to a portion of strap 150 by fastening means 169, preferably by stitching.

Similarly, additional secondary opening 174' is formed by folding strap 150 to create a second fold 177 where second strap end 151*b* extends a predefined distance sufficient to form second connection point 170 defined by second strap end 151*b* and a portion of strap 150. Second strap end 151*b* is fixedly attached at a second connection point to a portion of strap 150 by fastening means 171, also preferably stitching. Additional secondary opening 174' is defined between second fold 177, strap 150, second strap end 151*b*, and second connection point 170. Strap 150 makes first turn 162 and second turn 164 so that first fold 176 overlaps second fold 177 and forms closed loop 152.

A portion of connector 180 (e.g., the straight section 182 of a D-ring) passes through secondary opening 174. A portion of an additional connector 180' (e.g., the straight section 182 of a D-ring) passes through additional secondary opening 174'. As assembled, first fold 176 pass through opening 186' of additional connector 180' to secure connector 180 and overlap second fold 177, interlocking strap 150 with connector 180 and additional connector 180'. Connector 180 is preferably the same size or larger than additional connector 180' (in overall size or width) to prevent connector 180 from pulling though opening 186' of additional connector 180' and to prevent closed loop 152 from coming apart. Alternately, and second fold 177 could similarly pass through opening 186 of connector 180 to secure additional connector 180' and overlap first fold 176. Here, additional connector 180' is preferably the same size or larger than connector 180 to prevent additional connector 180' from pulling through connector 180. Preferably, connector 180 and additional connector 180' are D-rings, but other connectors may be used as described above.

In this embodiment, first strap portion 154 includes portions of strap 150 that pass along outside surface 132 of sleeve 130, first strap end 151*a*, and second strap end 151*b*, all of which are preferably positioned outside of sleeve 180 between first turn 162 and second turn 164 as shown in FIG. 10. Second strap portion 156 is the opposing portion of strap 150 that passes through passageway 136 of sleeve 130 between first turn 162 and second turn 164 as also shown in FIG. 10.

Figure 11:
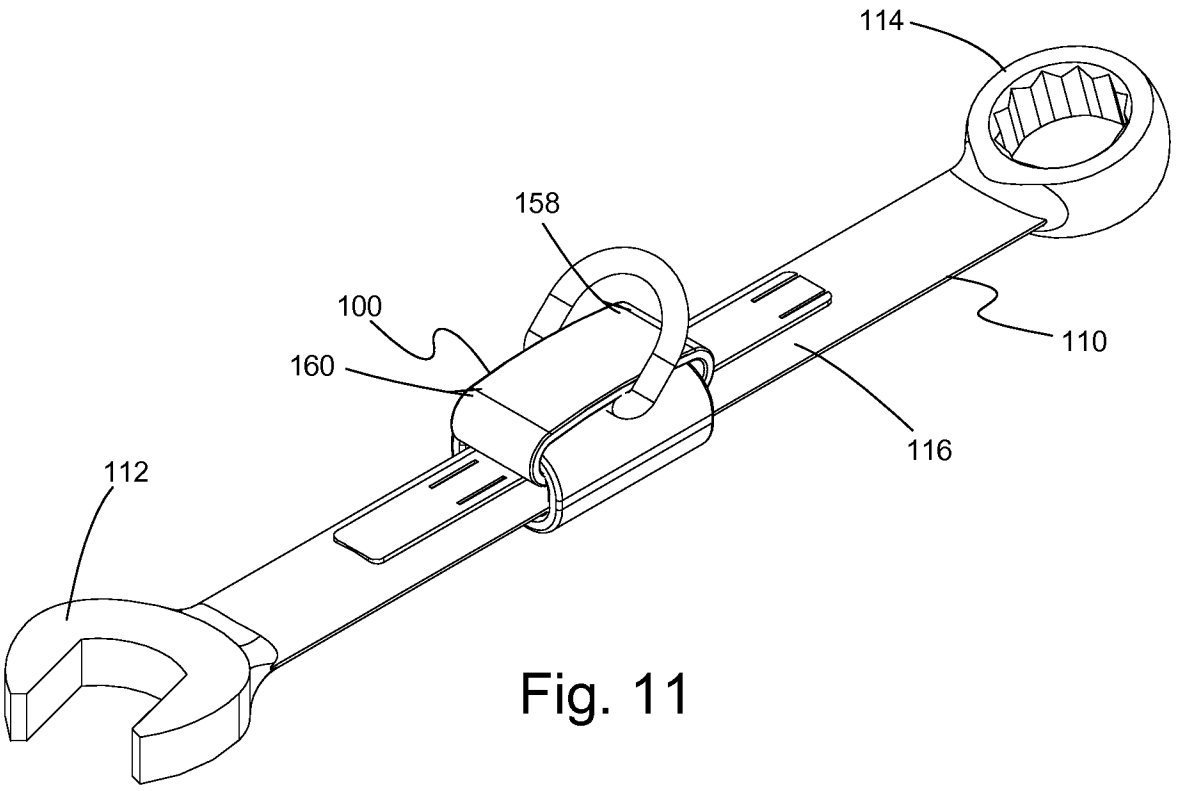
FIG. 11 illustrates a perspective view of the embodiment of FIG. 1 installed on a hand tool.

FIG. 11 illustrates the embodiment of lanyard attachment assembly 100 shown in FIG. 1 installed on a hand tool 110. Lanyard attachment assembly 100 is secured to tool 110 by forming a snug fit to a handle or middle portion 116. Tool 110 is a combination wrench, but lanyard attachment assembly may be used with other tools and objects including, for example, screwdrivers, utility knives, adjustable wrenches, hex wrenches, channel locks, pliers, punches, ratchet wrenches, flashlights, chisels, and the like.

Tool 110 has a first end 112 (e.g., an open end of a combination wrench), a second end 114 (e.g., a box end of a combination wrench), and a handle or middle portion 116 extending between first end 112 and second end 114. Lanyard attachment assembly 100 is particularly useful for tools having two functioning ends but either or both of first end 112 and second end 114 may be a featureless end of handle or middle portion 116. Thus, lanyard attachment assembly 100 is not limited for use with tools and could be used, for example, on a rod, block, or an irregular object. In one embodiment of lanyard attachment assembly 100, strap 100 is configured with sufficient slack around sleeve 130 to enable connector 180 to move along closed loop 152 between first end portion 158 and second end portion 160.

In one method of making lanyard attachment assembly 100, one selects a length of strap 150 having a first strap end 151*a* and second strap end 151*b*. One of the first strap end 151*a* or second strap end 151*b* is passed through passageway 136 of sleeve 130. One of the first strap end 151*a* and the second strap end 151*b* is optionally also passed through opening 186 of one or more connectors 180. First strap end 151*a* is then positioned to overlap second strap end 151*b* and the overlapping portion of strap 150 is fixedly secured with one or more fastening means to form a closed loop 152 with a primary opening 172 therethrough. The resulting assembly includes a strap 150 forming a closed loop 152*a* that links sleeve 130 to connector 180.

Strap 150 is optionally secured to itself at connection points with fastening means to define one or more fastener receiving openings or secondary openings 174. In another embodiment of making lanyard attachment assembly 100, the connector is not included, in which case lanyard attachment assembly 100 includes a sleeve 130 linked to a strap 150 forming a closed loop. In preferred embodiments of a method of making lanyard attachment assembly 100, sleeve 130 is heat shrink tubing, strap 150 is woven nylon webbing, and connector 180 is a metal D-ring.

To use lanyard attachment assembly 100, a user slips sleeve 130 over an end of hand tool 110 or other object. When sleeve 130 is made of rubber and sized to snugly fit to tool 110, the user first stretches or otherwise expands sleeve 130 so that it will pass over an end of tool 110 and then allows sleeve 130 to resume its relaxed shape as much as possible to provide a snug fit to tool 110. When sleeve 130 is made of heat shrink tubing, inside diameter 136' of sleeve 130 is sized to slip over an end of tool 110 or other object. The heat shrink tubing is selected with a shrink ratio that provides a snug fit to hand tool 110 when the heat shrink tubing is subsequently heated after placement onto hand tool 110. For example, the user slips sleeve 130 over the box end of a combination wrench and positions lanyard attachment assembly 100 along the middle portion 116 of the combination wrench. The user then heats the heat shrink tubing until it shrinks to provide a snug grip around the middle portion 116 of the wrench. When heat-activated adhesive 140 is present, heating activates adhesive 140 to bond sleeve 130 to tool 110 that, in addition to the snug grip on hand tool 110, provides additional gripping strength to hold lanyard attachment assembly 100 in place. Similarly, other varieties of adhesive 140 would also provide additional gripping strength to hold lanyard attachment assembly 100 in place.

Because sleeve 130 is linked with strap 150 and strap 150 is linked to connector 180, connector 180 is now secured to tool 100. The user may then clip or attach a lanyard through opening 184 of connector 180 to prevent tool 110 from falling if it is dropped, therefore reinforcing safety on a job site. If connector 180 is not included, the user may separately add a connector to the assembly or the user alternately may clip a lanyard directly to closed loop 152 formed by strap 150. Lanyard attachment assembly 100 further eliminates the need for workers to spend time retrieving dropped tools, which leads to increased worker productivity and reduced operating costs. Also, the closed loop 152 formed by strap 150 is stronger and more reliable than designs utilizing a leader strap held in place with heat shrink tubing.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lanyard attachment assembly for a hand tool comprising:

a strap made of a flexible material and defining a closed loop wherein the closed loop is flattened and defines an elongated first strap portion aligned with and opposing an elongated second strap portion, and wherein the elongated first strap portion is fixedly secured to the elongated second strap portion at one or more strap connection point to define a primary opening and one or more secondary opening through the closed loop between the elongated first strap portion and elongated second strap portion; and a tubing having a predefined length, an inside surface and an outside surface, the inside surface defining a passageway through the tubing, the tubing being changeable between an expanded state and a relaxed state, wherein when a hand tool is installed in the passageway, an elasticity of the tubing causes the tubing to snugly engage the hand tool;

wherein the first strap portion along the primary opening passes through the passageway of the tubing, thereby linking the tubular sleeve to the strap; and wherein the secondary opening is adapted to connect to an end of a lanyard.

2. The assembly of claim 1, further comprising at least one connector having a connector opening therethrough and installed through the one or more secondary opening and the at least one connector is adapted to connect to an end of a lanyard.

3. The assembly of claim 1, wherein the tubing is heat shrink tubing.

4. The assembly of claim 3, wherein the heat shrink tubing has a shrink ratio between about 2:1 and about 4:1.

5. The assembly of claim 1, further comprising an adhesive disposed on the inside surface of the tubing.

6. The assembly of claim 5, wherein the adhesive is heat activated.

7. The assembly of claim 2, wherein the connector is selected from the group consisting of a D-ring, an O-ring, a carabiner, a shackle, split ring, a tri-loop, an open ring, a loop, a hook, a snap hook, a spring buckle, and a spring clip.

8. The assembly of claim 1, wherein the strap is made of a material selected from the group consisting of nylon webbing, plastic, rubber, and combinations thereof.

9. The assembly of claim 1, wherein the elongated first strap portion is fixedly secured to the elongated second strap portion at the one or more strap connection point by stiching.

10. The assembly of claim 1, wherein the one or more secondary opening includes two secondary openings smaller than the primary opening and wherein the primary opening is positioned between the two secondary openings.

11. The assembly of claim 10, further comprising an adhesive disposed on the inside surface of the tubing.

12. The assembly of claim 11, wherein the adhesive is heat activated.

13. The assembly of claim 10, further comprising a connector installed through each of the two secondary openings wherein each connector is selected from the group consisting of a D-ring, an O-ring, a carabiner, a shackle, split ring, a tri-loop, an open ring, a loop, a hook, a snap hook, a spring buckle, and a spring clip.

14. The assembly of claim 10, wherein the strap is made of a material selected from the group consisting of nylon, plastic, rubber, and combinations thereof.

* * * * *